US007472430B2

(12) United States Patent
McDonald et al.

(10) Patent No.: US 7,472,430 B2
(45) Date of Patent: Jan. 6, 2009

(54) LAMINAR FLOW LIGHTED WATERFALL APPARATUS FOR SPA

(75) Inventors: Chris H. McDonald, Yorba Linda, CA (US); Douglas R. Gastineau, Costa Mesa, CA (US); Richard Kunkel, Murrieta, CA (US); Larry Childerston, Vista, CA (US)

(73) Assignee: Watkins Manufacturing Corporation, Vista, CA (US)

( * ) Notice: Subject to any disclaimer, the term of this patent is extended or adjusted under 35 U.S.C. 154(b) by 100 days.

(21) Appl. No.: 11/604,596

(22) Filed: Nov. 27, 2006

(65) Prior Publication Data

US 2007/0067899 A1 Mar. 29, 2007

Related U.S. Application Data

(62) Division of application No. 10/759,648, filed on Jan. 16, 2004, now Pat. No. 7,162,752.

(51) Int. Cl.
*E04H 4/00* (2006.01)

(52) U.S. Cl. ..... 4/507; 4/506; 4/541.5

(58) Field of Classification Search ..... 4/507, 4/506, 541.5; 239/18, 548, 289; 362/96, 362/149, 234, 555, 559, 800, 562
See application file for complete search history.

(56) References Cited

U.S. PATENT DOCUMENTS 4,749,126 A 6/1988 Kessener et al.
4,901,922 A 2/1990 Kessener et al.
4,936,506 A 6/1990 Ryan
5,115,974 A 5/1992 Tobias et al.
5,160,086 A 11/1992 Kuykendal et al.
6,076,741 A 6/2000 Dandrel et al.
6,170,094 B1 1/2001 Weise et al.
6,196,471 B1 3/2001 Ruthenberg
6,210,568 B1 4/2001 Harder
6,484,952 B2 11/2002 Koren
6,484,953 B2 11/2002 Freier
6,543,925 B2 4/2003 Kuykendal et al.
6,595,675 B2 7/2003 Dongo
6,637,676 B2 10/2003 Zieger et al.

OTHER PUBLICATIONS

Oreq Corporation product catalogue, Copyright 2001.

*Primary Examiner*—Khoa D Huynh
(74) *Attorney, Agent, or Firm*—Leon E. Redman

(57) ABSTRACT

A laminar flow waterfall in the form of a single or multiple streams of water, each exiting from a nozzle in the top edge of a spa. The laminar water stream is created by a venturi nozzle located in a plenum chamber. The inlet side of the nozzle has a cover with a plurality of small holes forcing the water flow to enter the nozzle as laminar flow. A flow divider inside the venturi nozzle, from the inlet to the restriction of the nozzle, maintains the flow laminar through the nozzle. Light is injected into the flow divider at the inlet and is carried by the flow divider to be injected into the water flow at the restriction of the nozzle.

22 Claims, 11 Drawing Sheets

LAMINAR FLOW LIGHTED WATERFALL APPARATUS FOR SPA

CROSS-REFERENCE TO RELATED APPLICATION

This application is a divisional of application Ser. No. 10/759,648 filed Jan. 16, 2004 for Laminar Flow Lighted Waterfall Apparatus for Spa issued as U.S. Pat. No. 7,162,752 on Jan. 16, 2007.

BACKGROUND OF THE INVENTION

1. Field of the Invention.

The present invention relates generally to improvements in spas or hot tubs, and more particularly, pertains to a new and improved waterfall apparatus in a spa.

2. Description of Related Art.

Waterfall structures are common in in-ground pool installations. These waterfall structures can take many shapes, providing different cascading water configurations such as sheet, falls, streams, tumbling waters, jets, for example. However, regardless of the form of the waterfall, the water flow is turbulent and driven by high pressure pump equipment. Such waterfall structures are not well adapted for use in portable spas for, among other reasons, the high pressure pumping power available in an in-ground pool is not available in a portable spa. Most of the pumping power in a portable spa is reserved for the generation of the water jets in the spa itself. As a result, waterfall structures utilized in spas tend to be merely trickles of water. The resulting waterfall effect is found lacking. The present invention, on the other hand, provides a waterfall of power and beauty without detracting from the pumping power needed in the spa for the spa's other functions.

SUMMARY OF THE INVENTION

A plenum chamber is constantly being filled with water at one end and ejecting a laminar stream of water at another end. Light of different colors may be injected into the laminar stream, causing it to change colors as desired. The laminar stream is created by a venturi nozzle in combination with a plenum chamber, with the venturi nozzle intake end in the plenum chamber. The intake end is covered with a sieve having many small holes. A flow divider in the venturi nozzle extends from the intake end to the outlet end, helping to create a laminar stream of water at the outlet end of the nozzle. A multi-color light source encased in a clear plastic rod is pointed into the water flow at the sieve intake of the venturi nozzle. The flow divider in the nozzle carries the light through the venturi nozzle body and emits it at the nozzle restriction. An escutcheon plate that fits over the outlet end of the venturi nozzle causes a small amount of air to be injected into the laminar flow stream as it exits the nozzle to cause some light carried by the flow stream to be deflected out of the stream.

BRIEF DESCRIPTION OF THE DRAWINGS

The exact nature of this invention, as well as its objects and advantages, will become readily appreciated upon consideration of the following detailed description when considered in conjunction with the accompanying drawings in which like reference numerals designate like parts throughout the figures thereof and wherein.

DETAILED DESCRIPTION OF THE PREFERRED EMBODIMENTS

Figure 1:
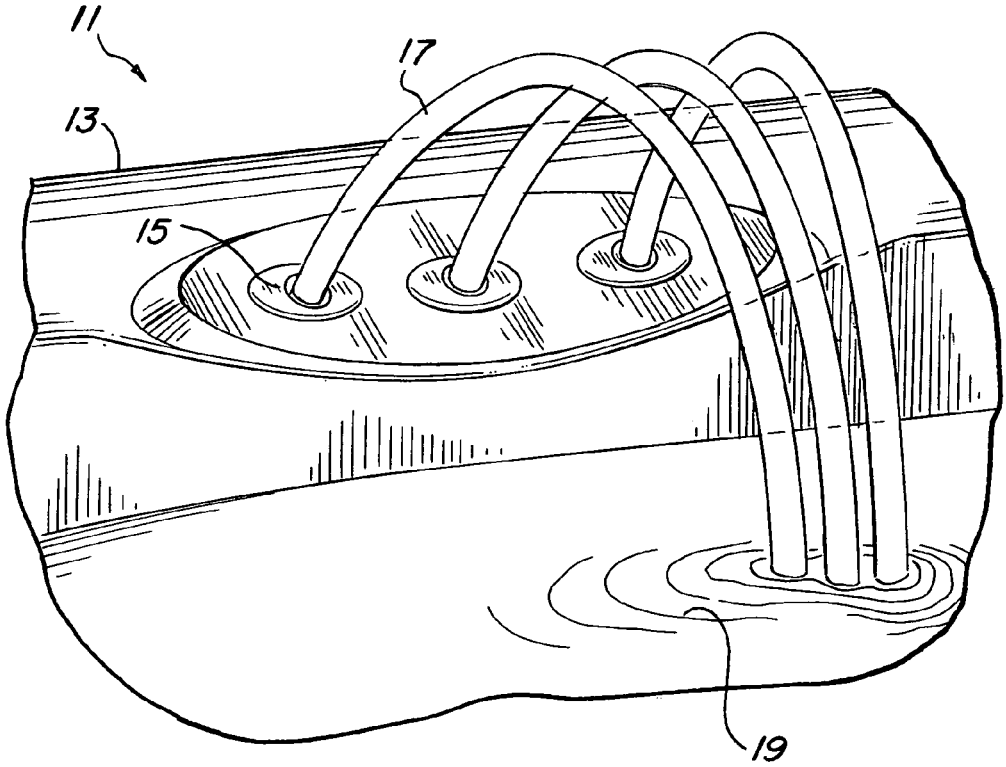
FIG. 1 is a perspective illustration of a three-stream waterfall in a spa, according to the present invention.

FIG. 1 illustrates a preferred installation 11 of the waterfall apparatus of the present invention in a three stream configuration which utilizes a plurality of nozzles 15 mounted within the top side 13 of a spa wall. The nozzles 15 are mounted at an incline to cause the streams of water 17 exiting from the nozzles to fall into a main body of water 19 contained in the spa.

As will be explained in further detail hereinafter, each stream of water 17 exiting its nozzle 15 is laminar flow as distinguished from turbulent flow. The laminar flow water steam 17 is lit up and carries light like a light conduit, until the stream 17 hits the main body of water 19. Upon hitting the main body of water 19, the light within the laminar flow stream scatters, creating a desirable, pleasing and relaxing effect.

Figure 2:
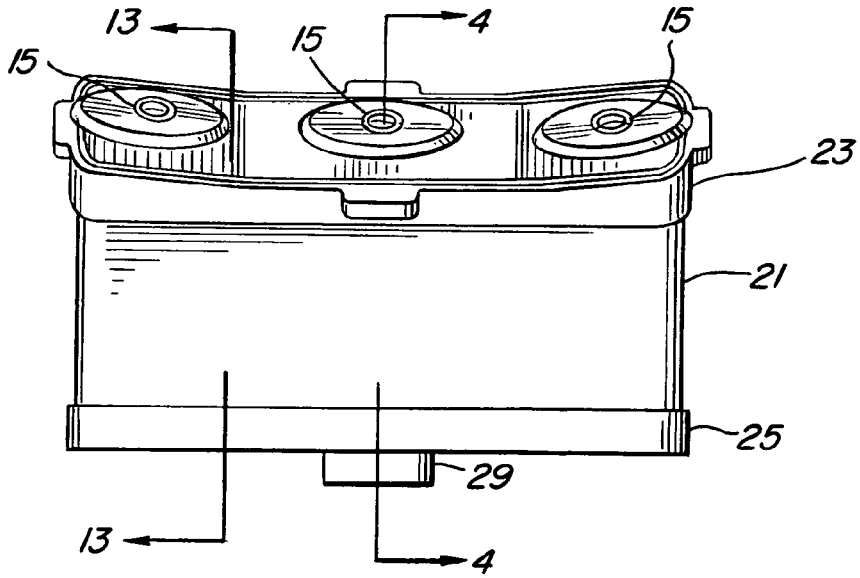
FIG. 2 is a front perspective of the waterfall apparatus of the present invention.

FIG. 2 is a perspective illustration of the waterfall stream generating apparatus according to a preferred embodiment of the present invention. The apparatus includes a plenum chamber 21 which is closed by a top 23 having a plurality of nozzles 15. It should be understood that any number of nozzles may be utilized, as long as the principles of the invention are followed. The plenum chamber 21 has a bottom 25 with a water inlet pipe socket 29 for connecting to a water pumping system of the spa.

Figure 3:
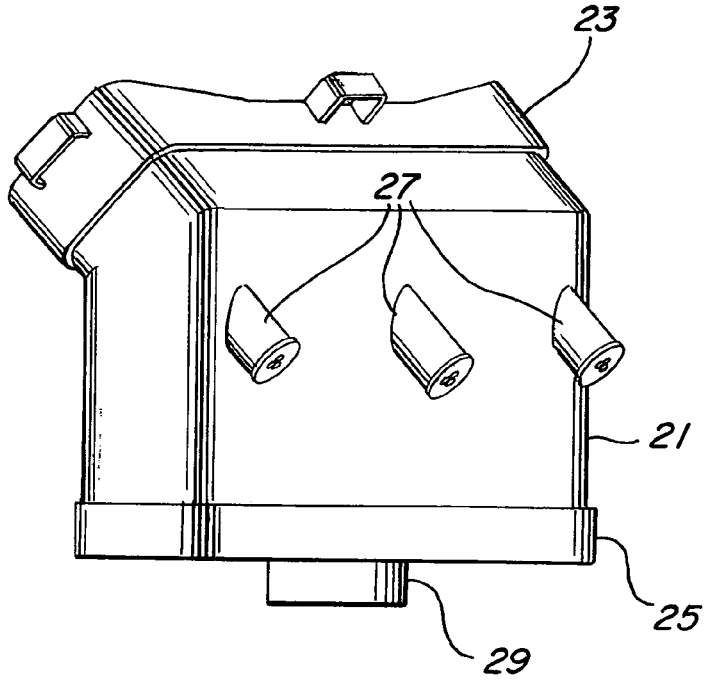
FIG. 3 is a back perspective of the waterfall apparatus of the present invention.

Looking at the back side of plenum chamber 21 in FIG. 3, it becomes clear that the plenum chamber top 23 is angled so that the jets 15 mounted in the top 23 are aimed in a sideways direction rather than straight up. The back side illustration also shows a plurality of light source access channels 27 into the plenum chamber 21.

Figure 4:
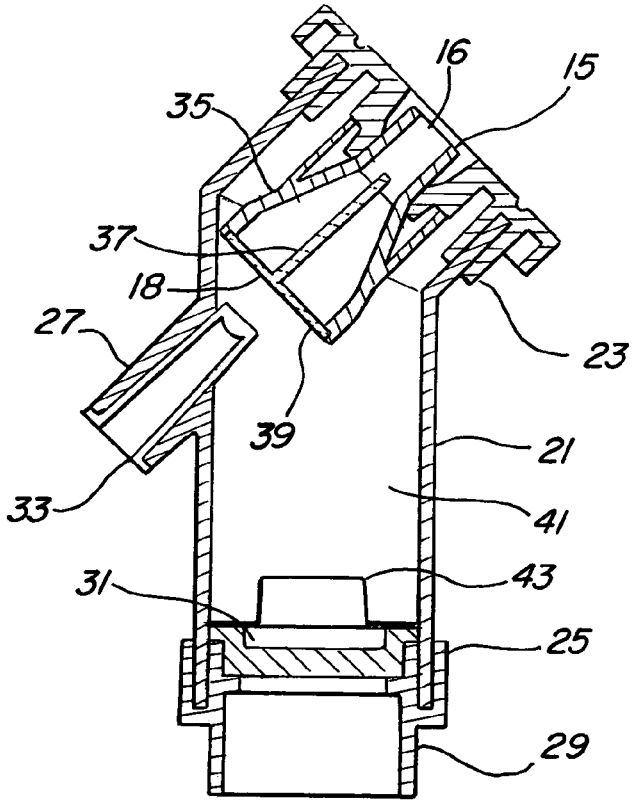
FIG. 4 is a cross-section taken along line 4-4 of FIG. 2 looking in the direction indicated by the arrows.

FIG. 4 illustrates the inside of the plenum chamber 21 cut along line 4-4 of FIG. 2, looking in the direction of the arrows. The plenum chamber 21 is divided into smaller spaces or sub-chambers by walls 41 that define a smaller plenum sub-chamber around each nozzle 15. Water flow between the nozzle sub-chambers is facilitated by a notch 43 cut out at the bottom of the wall 41.

Each nozzle 15 is a venturi nozzle 35 having a larger diameter inlet 18 located in the plenum chamber 21, with a smaller diameter outlet 16 located in the top 23 of the plenum chamber 21. A flow divider 37 extends from the inlet 18 to at least the restriction of venturi nozzle 35. Inlet 18 of the nozzle is covered by a sieve cap 39 having many small apertures.

The light source access channel 27 into the plenum chamber 21 contains a plastic optical conductor tube 33 that is solid at the end located in the plenum chamber. The solid end is pointed directly at the center of the sieve cap 39 at the inlet 18 of venturi nozzle 35.

The inlet pipe socket 29 in the bottom 25 of plenum chamber 21 contains a flow director 31 that directs water to all the nozzle sub-chambers within plenum chamber 21, as will be explained hereinafter. The flow director 31 incorporates a course sieve for controlling water flowing into the plenum sub-chambers from inlet pipe socket 29.

Figure 5:
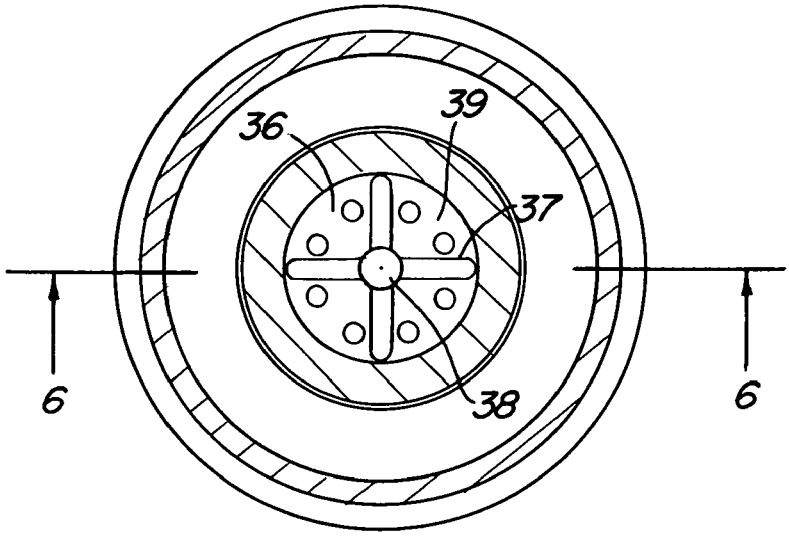
FIG. 5 is a cross-section of a venturi nozzle according to the present invention along a plane perpendicular to flow through the nozzle.
Figure 6:
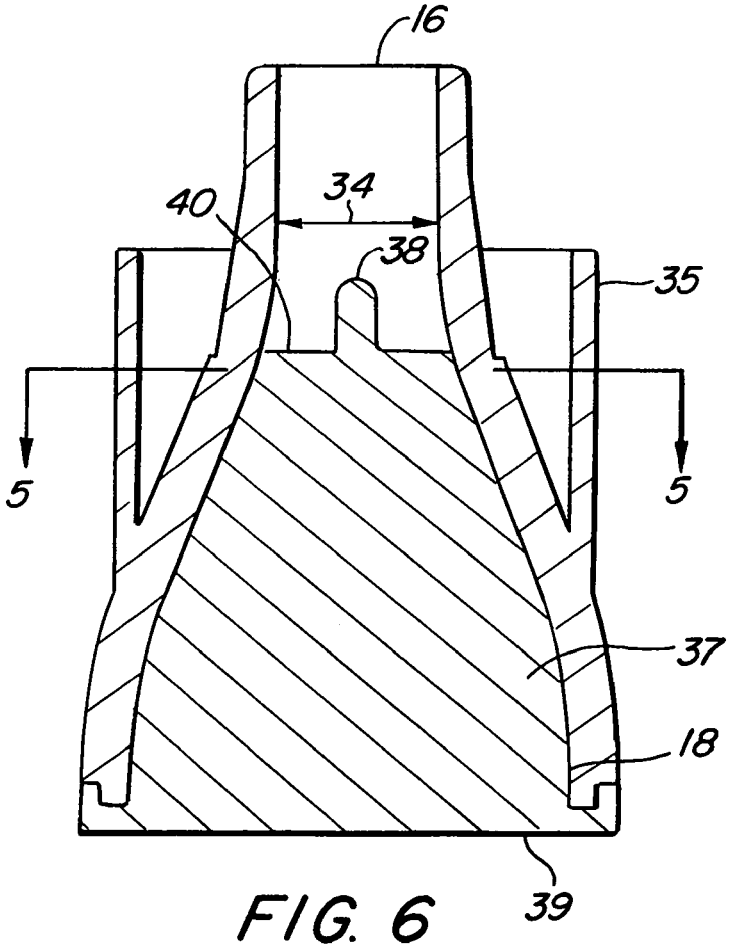
FIG. 6 is a cross-section of a venturi nozzle according to the present invention along a plane parallel to flow through the nozzle.

FIG. 5 is a cross-section of the venturi nozzle 35 taken along a plane perpendicular to flow through the nozzle. An illustration of the flow divider 37 looking from the outlet 16 is presented. Flow divider 37 has a cross configuration with a rounded shaft 38 at its symmetrical center. The shaft 38 points in the direction of the outlet 16. FIG. 6 shows a cross-section of one of the arms of the flow divider 37. As can be seen from the cross-section in FIG. 6, the flow divider conforms to the shape of the venturi nozzle 35 so that the flow divider entrance is large at the inlet end 18 covered by sieve cap 39 and smaller as the flow divider extends towards the restrictive throat 34 of the venturi nozzle 35. Looking down into the outlet opening 16 of venturi nozzle 35 towards the inlet in FIG. 5, one can see the inlet sieve cap 39 and the plurality of apertures therein.

The location of the top or exit 40 of the flow divider 37 is determined according to the size relationship between the flow area at the top 40 of the flow divider 37 and the flow area 34 at the restriction or minimal cross-sectional area of venturi nozzle 35.

Looking again at FIG. 5, the flow area at the top or exit 40 of flow divider 37 is determined by the open spaces 36 between the arms of the flow divider 37. The actual flow area at the top or exit 40 of flow divider 37 is determined as follows. Determine the cross-sectional area of the nozzle 35 at the location of the top or exit 40 of the flow divider. Determine the cross-sectional area of the thicknesses of the arms of flow divider 37 at the top or exit 40. Subtract the cross-sectional area of the arms from the cross-sectional area of the nozzle. This is the flow area at the top or exit 40 of the flow device. This flow area must be equal to or greater than the flow area 34 at the minimum cross-sectional area or restriction of the venturi nozzle 35. It has been found through experimentation that this relationship is critical to removing air bubbles from the laminar flow in the nozzle, which may form at system startup or during the course of normal operation. The presence of air bubbles in the nozzle influences fluid flow through the nozzle in a negative and undesirable way.

Turbulence in the fluid flow into the venturi nozzle 35 is reduced by the holes in the inlet sieve cap 39 of the venturi nozzle 35. These holes tend to equalize the velocities within the general fluid flow. The flow divider 37 continues this process of flow velocity equalization while increasing fluid velocity just prior to releasing of the fluid into ambient atmosphere at the outlet 16 of the nozzle.

Figure 7:
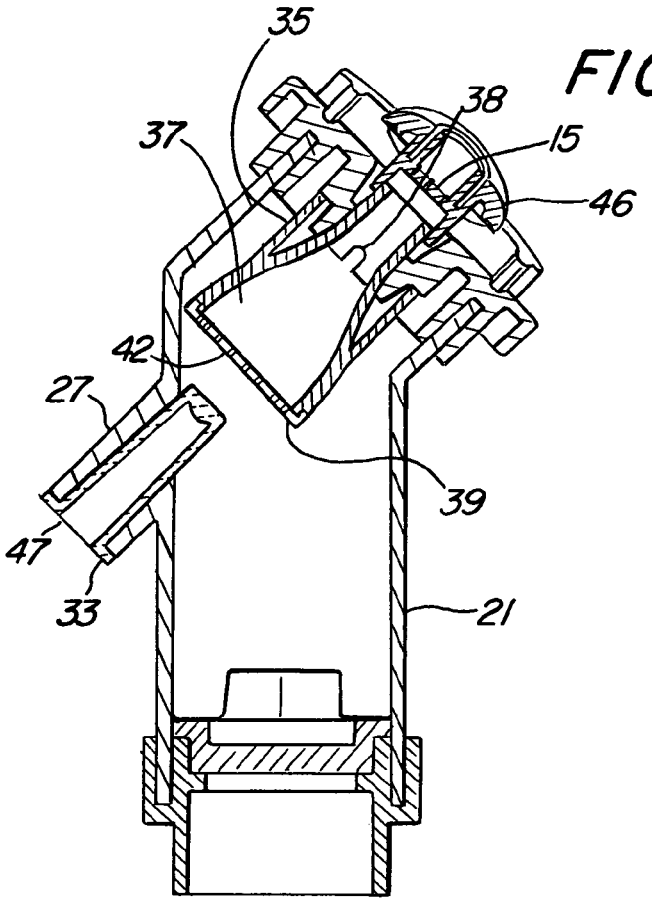
FIG. 7 is a cross-section of the venturi nozzle and plenum chamber, along a plane parallel to flow through the chamber and nozzle.
Figure 8:
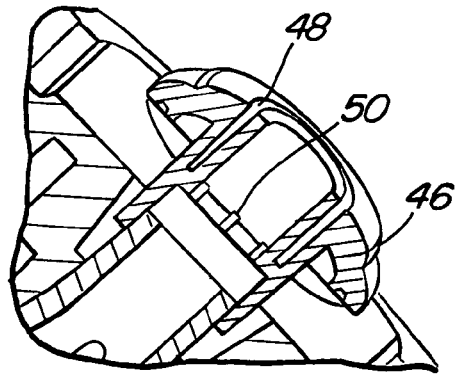
FIG. 8 is a cross-section of the venturi nozzle outlet and its escutcheon plate.

FIG. 7 more clearly illustrates how a light beam generated by a light source 47 (FIG. 20) gets injected into the laminar flow inside venturi nozzle 35. The plastic light tube 33 within access channel 27 of plenum chamber 21 has a light focusing lens 34 at its output end. The lens 34 focuses light from within light tube 33 onto a light gathering lens 42 formed into the center of plastic inlet sieve cap 39 of venturi nozzle 35 at the location of light emitter shaft 38. Light from the light source 47 enters the system through plastic tube 33, is focused by lens 44, and travels a short distance through the water in plenum chamber 21 to the light gathering lens 42 formed in inlet sieve cap 39. The lens 42 in the sieve cap 39 gathers the light and concentrates it into the clear plastic flow divider 37, specifically the light shaft 38 at its symmetrical center. The light then travels through the flow divider 37 primarily through the light emitter shaft 38 to the output end. Use of the flow divider as a light tube minimizes light loss and maximizes the light transference from the light source 47 to the fluid flow within venturi nozzle 35 that is most laminar. The fluid flow then carries the light into the atmosphere as fluid stream exiting nozzle 15.

Because of laminar flow exits nozzle 15, it was found that the light within the laminar fluid flow stream was only visible within a very narrow viewing angle, i.e., directly in front of the flow stream. In order to make the light within the laminar fluid flow viewable from all angles, a method of introducing air bubbles into the laminar fluid flow was devised. By introducing air bubbles into the laminar fluid flow as it exits the nozzle 15, reflective light surfaces were created which caused a portion of the light in the laminar flow to scatter and escape the water stream. The fluid stream 17 thus appeared to be lit up to the casual viewer for a much larger viewing angle, i.e., from all sides.

Figure 9:
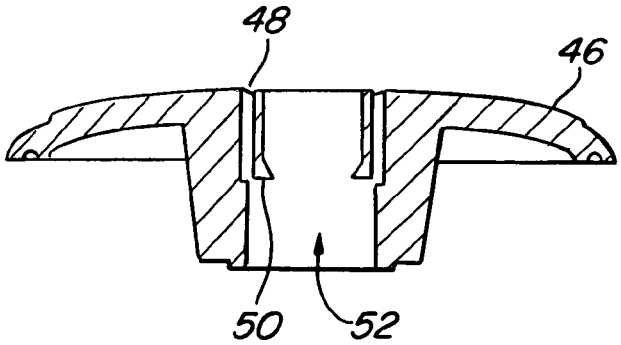
FIG. 9 is a partially broken-away section of the escutcheon plate of FIG. 8.

According to the accepted principles of Bemoulli's equation regarding pressure and velocity in an incompressible fluid flow environment, air is entrained into the fluid flow by reducing fluid pressure and increasing fluid velocity past the air induction points. The current invention utilizes this principle, but is unique in that it captures air at the top of the escutcheon 46 that fits over the nozzle 15 and directs the air to the laminar flow within the venturi nozzle 35 at points 50 by way of an air path 48 carved into the escutcheon 46. Thus, the air being introduced into the laminar flow 52 (FIG. 9) is traveling in a direction opposite to a laminar flow, until it is introduced into the flow path 52.

Figure 10:
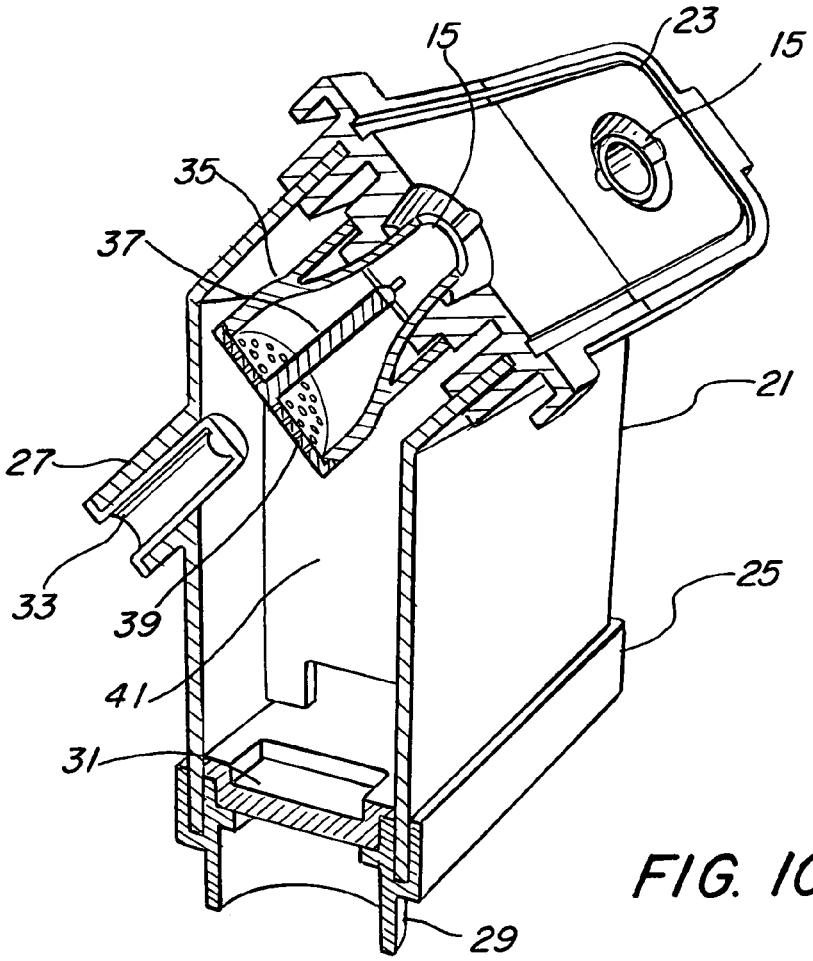
FIG. 10 a cross-section and perspective of the waterfall apparatus of FIG. 4 taken along a bisecting plane parallel to flow.

Referring now to FIG. 10, the water flow director 31 extends along the entire length of plenum chamber 21 from the center segment of plenum chamber 21 to both ends of plenum chamber 21. FIG. 10 illustrates more clearly the apertures in the inlet sieve cap 39 for the venturi nozzle 35. These apertures, along with the flow divider 37, within the venturi nozzle 35, cause the body of water in plenum chamber 21 beneath venturi nozzle 35 to exit the outlet 16 of venturi nozzle 35 as a laminar stream at high volume.

Figure 11:
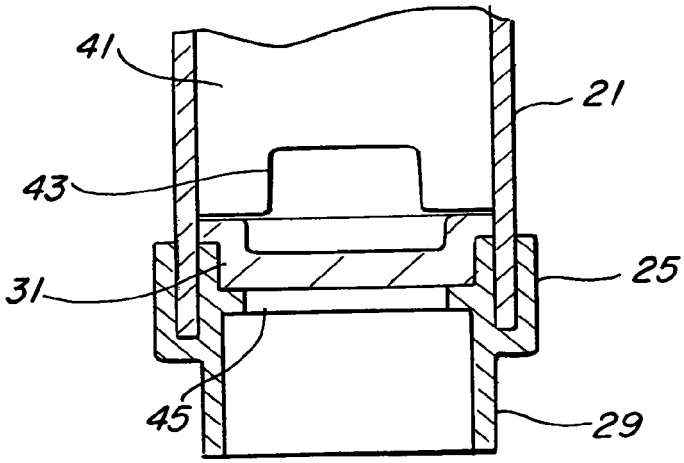
FIG. 11 is an exploded view of the bottom portion of FIG. 10.

FIG. 11 illustrates the inlet of plenum chamber 21 more clearly, showing the inlet pipe socket 29 which feeds water through an aperture 45 in the bottom 25 of plenum chamber 21 into a flow director 31 which directs flow not only into the plenum sub-space below the nozzle directly above it, but also into the other nozzle plenum sub-spaces below the other nozzles in plenum chamber 21. These nozzle plenum sub-spaces are created by walls 41 within plenum chamber 21. The pressure throughout plenum chamber 21 is equalized by notches 43 located in the base of each wall 41 in the plenum chamber, to allow the pressurized water in each of the nozzle plenum sub-spaces to communicate with each other.

Figure 12:
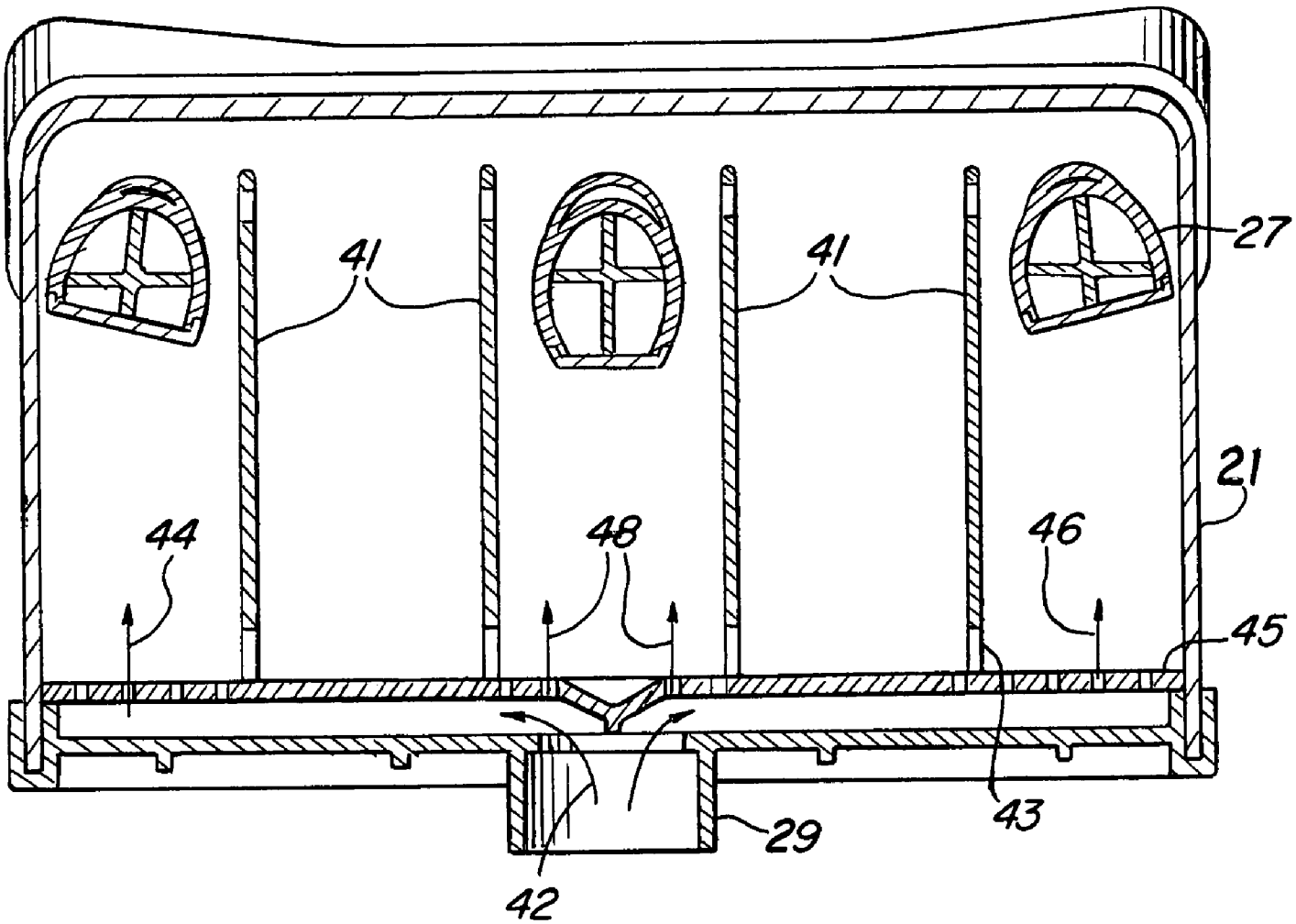
FIG. 12 is a partially broken-away section of the plenum chamber showing the intake flow director.

FIG. 12 illustrates more clearly the bottom 25 of plenum chamber 21 and the internal plenum sub-spaces created by walls 41 within plenum chamber 21. Fluid 42 enters plenum chamber 21 through the pipe socket 29. This fluid flow is turbulent. It is immediately separated into two flows 44 and 46 by a V-shaped flow director 31. A sieve plate 45 covers the entire inlet bottom of plenum chamber 21. The fluid flow into the three plenum sub-chambers 44, 48 and 46 are more pressure equalized and contain less turbulence as the result of the sieve plate 45 and the flow channels in flow director 31.

Figure 13:
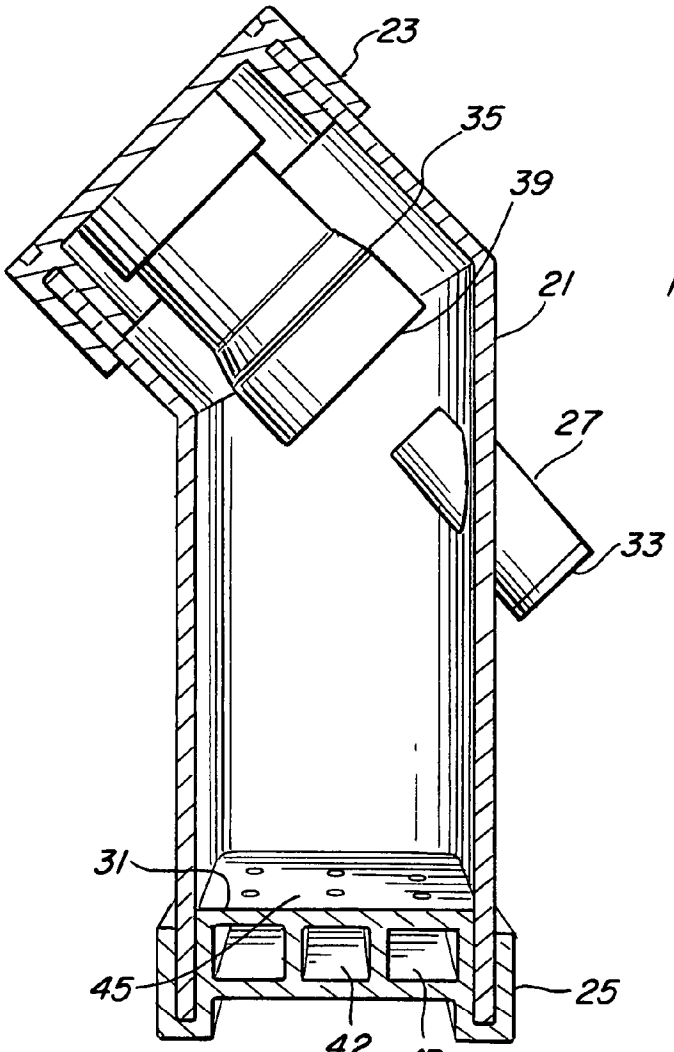
FIG. 13 is a cross-section taken along line 13-13 of FIG. 2 looking in the direction of the arrows.

FIG. 13 is an alternate view of the inside of the plenum chamber 21 when a different section of FIG. 2 is taken along line 13-13 looking in the direction of the arrows. The external structure of venturi nozzle 35 is sealed to the top 23 of plenum chamber 21. The light source access channel 27 permits the light transmissive plastic tube 33 to be inserted into the plenum chamber 21 so that its end points directly into the center of inlet sieve plate 39 of venturi nozzle 35. The end of the plastic light tube 33 is solid, thereby sealing any light source contained within tube 33 within its confines and focusing the light out of the end containing the focusing lens.

The flow director 31 at the bottom of plenum chamber 21 is more clearly illustrated as containing a plurality of flow dividers 43 within the flow director 31. The water that enters plenum chamber 21 through the pipe socket 29 starts flowing in a more disciplined fashion as a result. The fluid moves into plenum chamber 21 through a course sieve 45 that is more clearly illustrated in FIG. 14, becoming less turbulent as it does.

Figure 14:
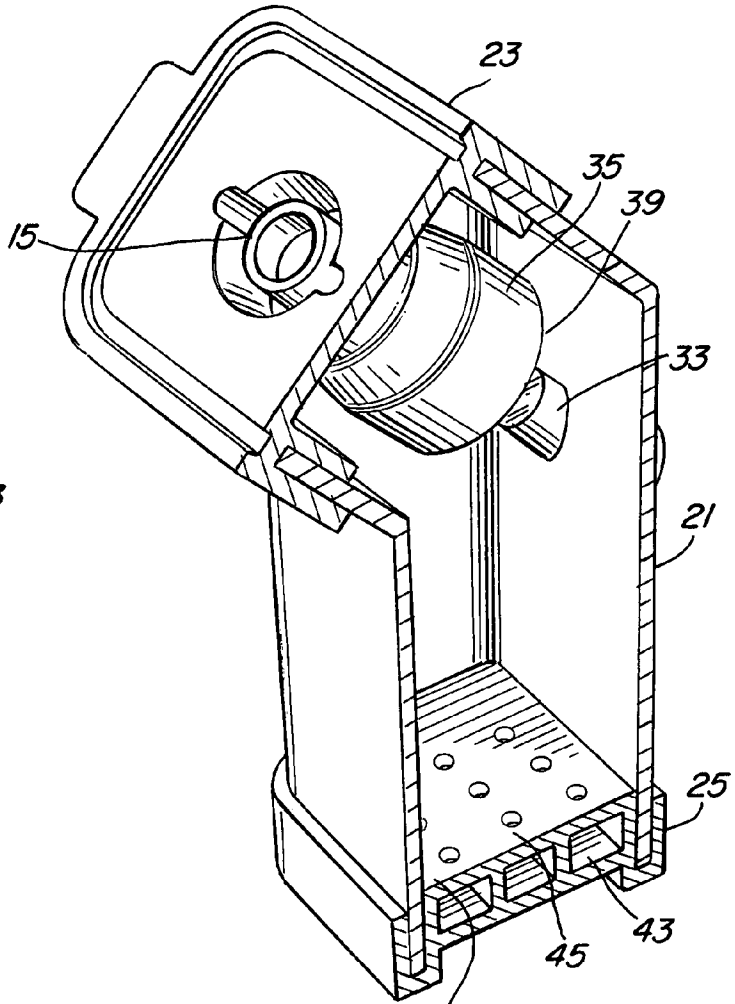
FIG. 14 is an alternate perspective of the section shown in FIG. 13.

FIG. 14 illustrates the sieve structure of flow director 31 and the proximity of the end of light conduit 33 with the inlet sieve plate 39 of venturi nozzle 35.

Figure 15:
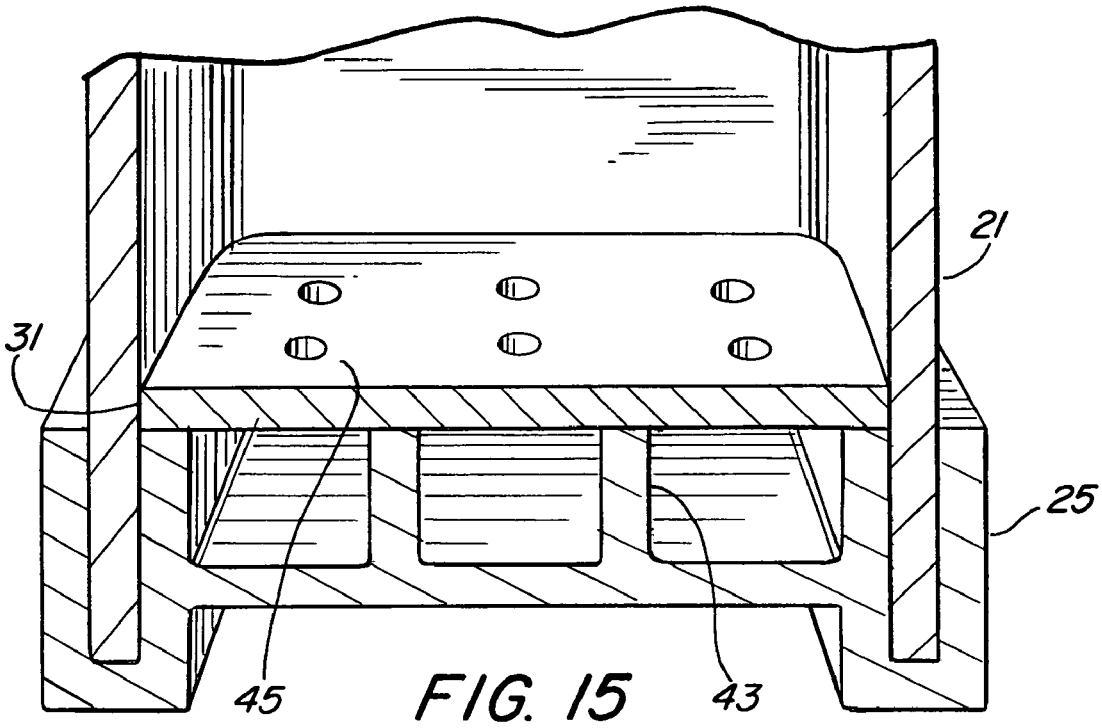
FIG. 15 is an exploded view of the bottom part of FIG. 13.

FIG. 15 illustrates the flow director 31, its sieve top 45 and the flow dividers 43 contained within the flow director which extends along the bottom 25 of plenum chamber 21.

Figure 16:
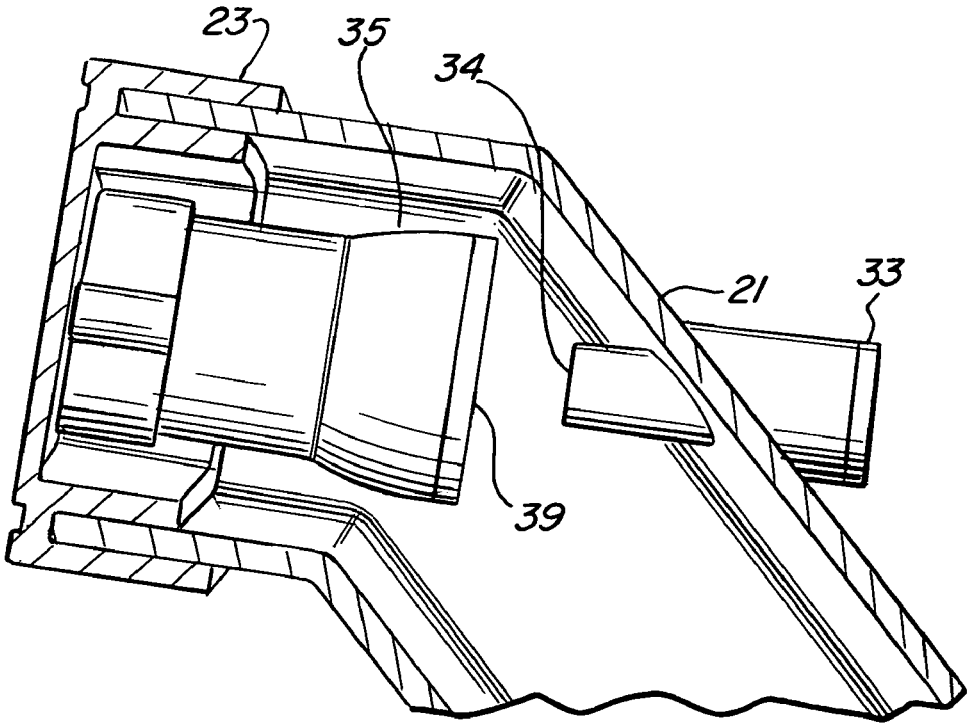
FIG. 16 is an exploded view of the top part of FIG. 13.

FIG. 16 is a close-up of venturi nozzle 35 showing how it is sealed to the top 23 of plenum chamber 21 and the relationship between the light outputting lens 34 of light channel 33 and the input sieve cap 39 of venturi nozzle 35.

Figure 17:
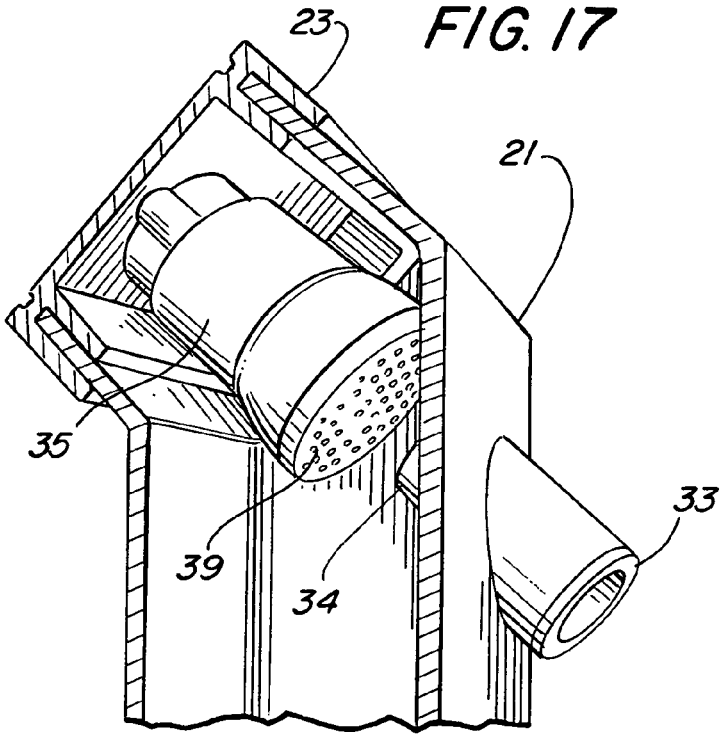
FIG. 17 is an alternate perspective view of the part shown in FIG. 16.
Figure 18:
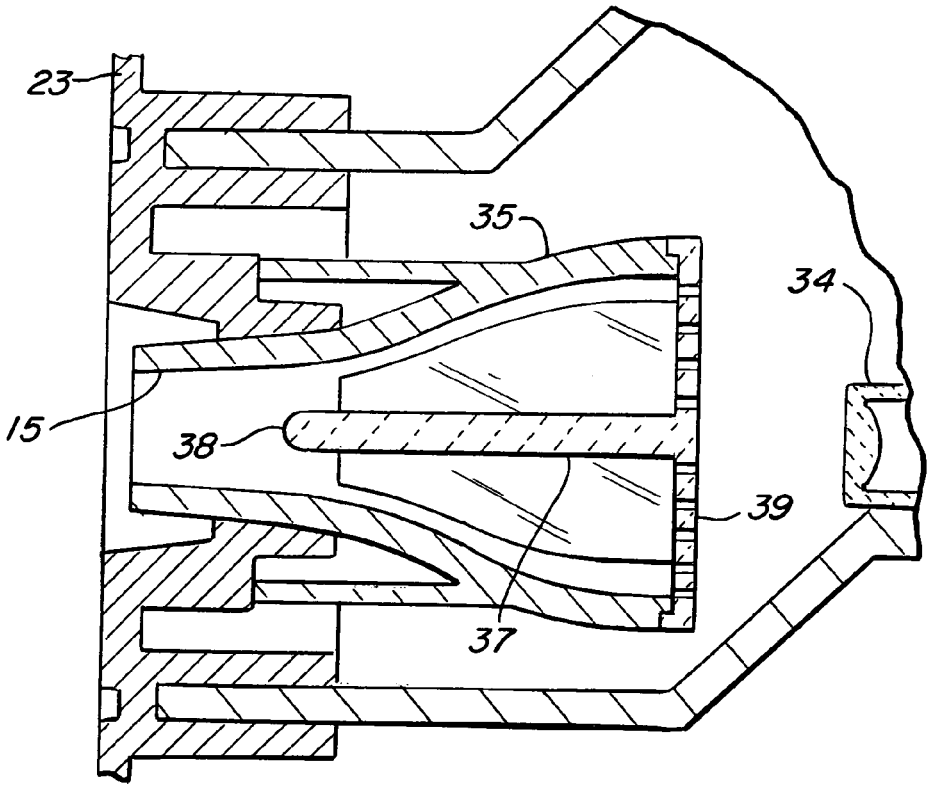
FIG. 18 is an exploded view of the top part of FIG. 4.

The sieve structure of the input cap 39 of venturi nozzle 35 is more clearly illustrated in FIGS. 17 and 18. A flow divider 37 attached to the sieve cap extends from the input 39 to the restriction of the venturi nozzle 35. Flow divider 37, in conjunction with the apertures in the sieve cover of inlet 39, is the final link, causing the stream ejected from outlet 16 to be laminar. The light ejected from the focusing lens end 34 of light tube 33 is injected into the laminar flow by the light emitter shaft 38 in the flow divider 37, causing the water flow to carry the light within the confines of its stream.

Figure 19:
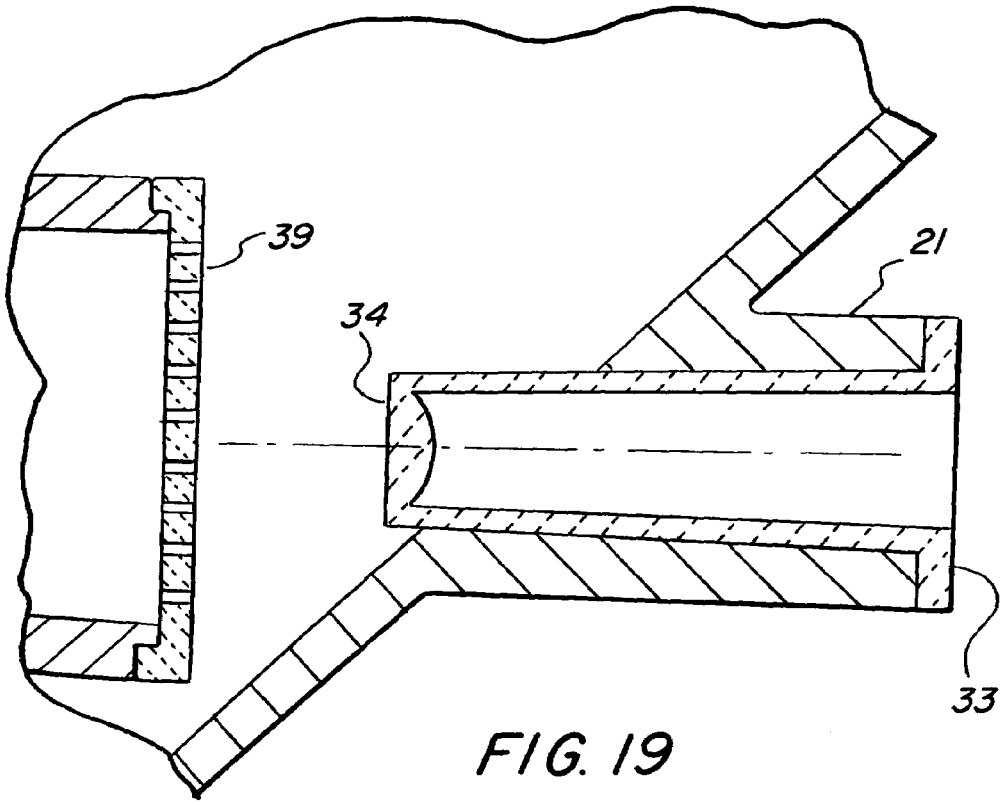
FIG. 19 is an exploded cross-section of the light injector of FIG. 17.

FIG. 19 more clearly illustrates the close relationship between the sieve inlet plate 39 of the venturi nozzle and the light outputting lens end 34 of light tube 33 in plenum chamber 21.

Figure 20:
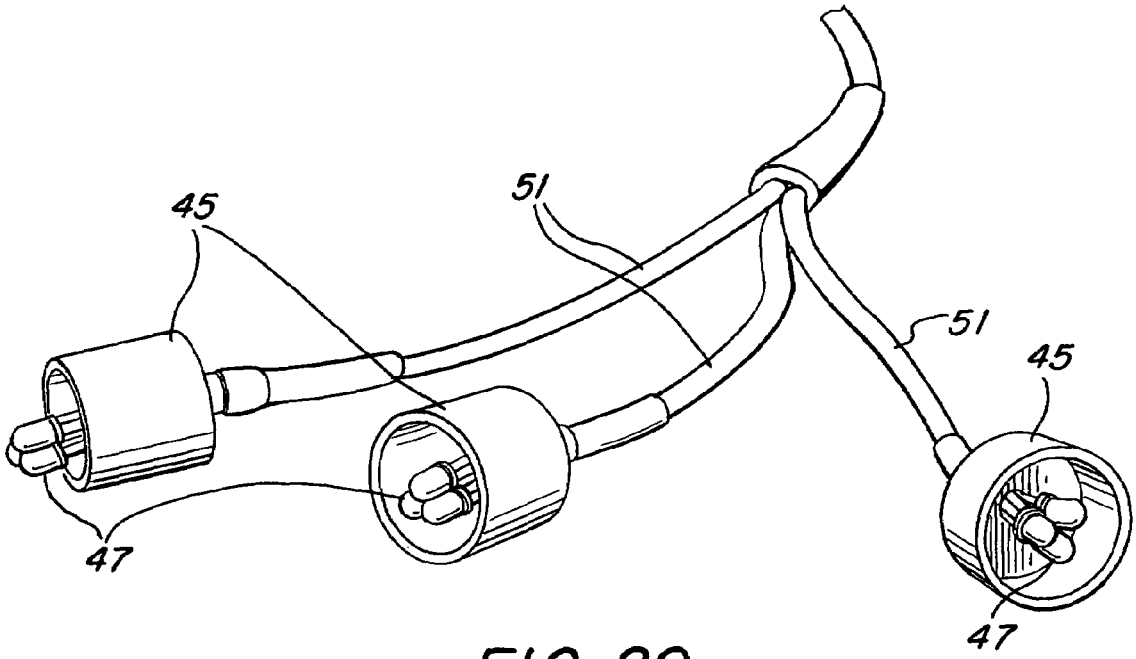
FIG. 20 is a perspective of the light source used in the light injection.

A preferred light source for insertion into light tube 33 is a plurality of LEDs 47 grouped in threes as shown in FIG. 20. LEDs are preferred because of low power requirements and the ability to create a variety of colors by use of the three base colors, red, blue and green, with each one of the three LEDs being one of these base colors.

Figure 21:
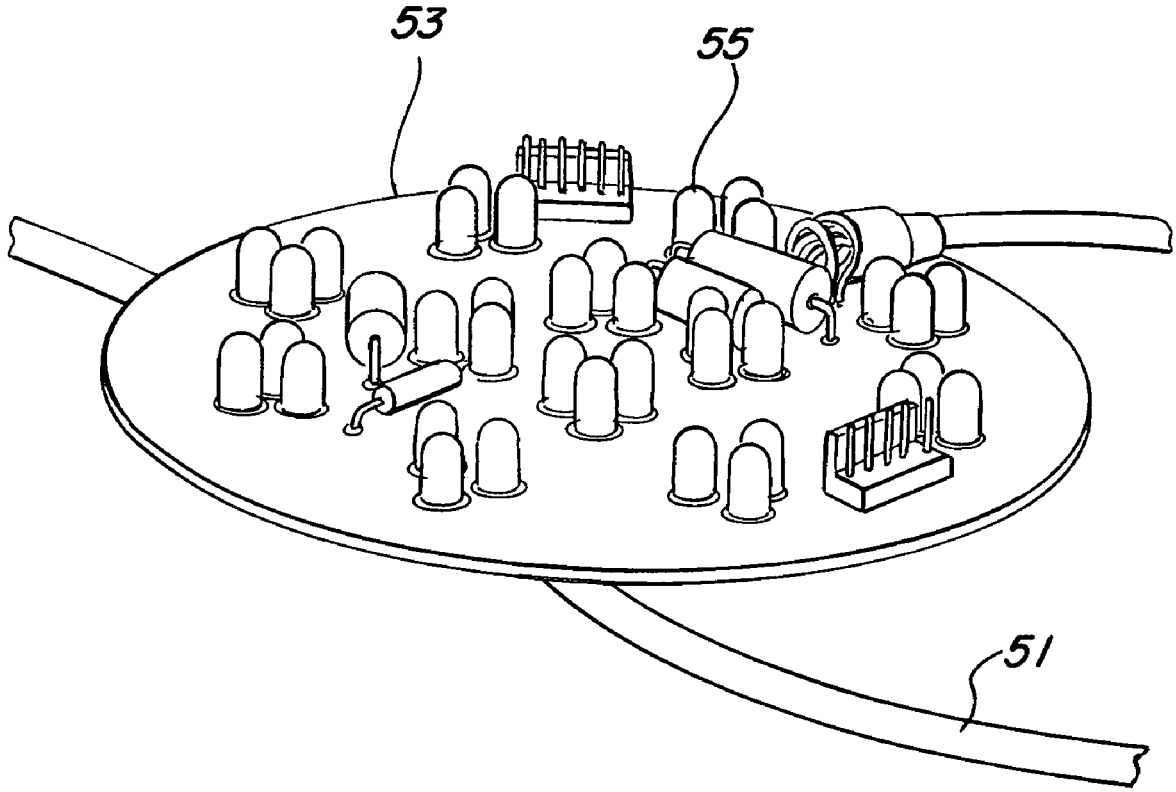
FIG. 21 is a perspective of the main spa light and control circuit used in connection with the light source of FIG. 20.

This particular arrangement allows for the generation of a variety of different colors for each of the streams of water being ejected from the venturi nozzle. These colors are controlled by an electronic circuit 53 (FIG. 21) which also controls the main light 55 in the spa. The color sequencing of the main light 55 preferably matches the color sequencing of the individual lights 47 in the waterfall 17.

The light generating circuitry 53 is more fully described in U.S. Pat. No. 6,435,691 granted Aug. 20, 2002 for Light Apparatus of Portable Spas and the Like, the complete disclosure of that patent being incorporated herein by reference.

It should be understood that the color source for the individual streams of water being ejected from the venturi nozzles may take other forms than as specifically described herein.

What is claimed is:

1. An apparatus for injecting light into a stream of water, the apparatus comprising:

a nozzle having an inlet, a converging in section, a throat and an outlet, water injected into the inlet exiting the outlet in a stream, the inlet having a cross-sectional area greater than the outlet, the outlet having a cross-sectional area greater than or equal to the cross-sectional area of the throat;

a light channel having a first and second end, the first end being in the water at the inlet of the nozzle; and a light emitter shaft made of a light transmitting material having a first and second end, located in the converging section of the nozzle between the inlet and outlet with the first end pointing at the first end of the light channel, and the second end pointing at the outlet of the nozzle, the light emitter being located a distance from the light channel.

2. The light injecting apparatus of claim 1 further comprising:

a lens at the first end of the light channel for focusing light exiting the first end.

3. The light injecting apparatus of claim 1 wherein the light channel is closed at the first end and open at the second end.

4. The light injecting apparatus of claim 3 further comprising:

a lens at the first end of the light channel for focusing light exiting the first end.

5. The light injecting apparatus of claim 3 further comprising:

an LED light source at the second end of the light channel.

6. The light injecting apparatus of claim 5 wherein the LED light source comprises a plurality of different color LEDs.

7. The light injecting apparatus of claim 6 wherein the plurality of different color LEDs comprises a red, green and blue LED.

8. The light injecting apparatus of claim 2 wherein the lens at the first end of the light channel focuses light onto the first end of the light emitter shaft.

9. The light injecting apparatus of claim 8 wherein the second end of the light emitter shaft injects light into the stream of water exiting the nozzle outlet.

10. The light injecting apparatus of claim 9 wherein the second end of the light emitter shaft is located in about the center of the nozzle.

11. The light injecting apparatus of claim 10 wherein the first end of the light emitter shaft is located in about the center of the nozzle.

12. The light injecting apparatus of claim 11 wherein the light channel is closed at the first end and open at the second end, the second end being outside of the water.

13. The light injecting apparatus of claim 12 further comprising:

an LED light source at the second end of the light channel.

14. The light injecting apparatus of claim 13 wherein the LED light source comprises a plurality of different color LEDs.

15. The light injecting apparatus of claim 14 wherein the plurality of different color LEDs comprises a red, green and blue LED.

16. The light injecting apparatus of claim 11 further comprising a flow divider connected to the light emitter shaft in the nozzle.

17. The light injecting apparatus of claim 16 wherein the flow divider comprises a plurality of flat panels extending along the length of the light emitter shaft in the nozzle, the panels being aligned with the flow of water through the nozzle.

18. The light injecting apparatus of claim 17 further comprising a sieve at the inlet of the nozzle supporting the plurality of flat panels the sieve being transverse to the flow of water through the nozzle.

19. The light injecting apparatus of claim 18 wherein the light channel is closed at the first end and open at the second end, the second end being outside of the water.

20. The light injecting apparatus of claim 19 further comprising:

an LED light source at the second end of the light channel.

21. The light injecting apparatus of claim 20 wherein the LED light source comprises a plurality of different color LEDs.

22. The light injecting apparatus of claim 21 wherein the plurality of different color LEDs comprises red, green and blue LEDs.

* * * * *